US008931416B2

(12) United States Patent
Schneider et al.

(10) Patent No.: US 8,931,416 B2
(45) Date of Patent: Jan. 13, 2015

(54) INERT AND PRESSURE-ACTUATED SUBMUNITIONS DISPENSING PROJECTILE

(71) Applicants: Shawn P. Schneider, King George, VA (US); Steven C. Tebrich, Fredericksburg, VA (US); Marin A. Kobin, Fredericksburg, VA (US); Seth L. Williamson, King George, VA (US); Bradford Scott Smith, Fredericksburg, VA (US); Stephen Dix, Fredericksburg, VA (US)

(72) Inventors: Shawn P. Schneider, King George, VA (US); Steven C. Tebrich, Fredericksburg, VA (US); Marin A. Kobin, Fredericksburg, VA (US); Seth L. Williamson, King George, VA (US); Bradford Scott Smith, Fredericksburg, VA (US); Stephen Dix, Fredericksburg, VA (US)

(73) Assignee: The United States of America as Represented by the Secretary of the Navy

( * ) Notice: Subject to any disclaimer, the term of this patent is extended or adjusted under 35 U.S.C. 154(b) by 2 days.

(21) Appl. No.: 13/788,436

(22) Filed: Mar. 7, 2013

(65) Prior Publication Data

US 2014/0251173 A1 Sep. 11, 2014

(51) Int. Cl.

| | |
|---|---|
| ***F42B 12/58*** | (2006.01) |
| ***F42B 12/60*** | (2006.01) |
| ***F42B 12/64*** | (2006.01) |

(52) U.S. Cl.

CPC ..... *F42B 12/60* (2013.01)
USPC ..... 102/489; 102/520; 102/449; 102/457

(58) Field of Classification Search

CPC ..... F42B 12/64; F42B 14/065; F42B 7/10
USPC ..... 102/393, 438, 448, 449, 456, 457, 489, 102/506, 520, 521, 522, 703
See application file for complete search history.

(56) References Cited

U.S. PATENT DOCUMENTS

| | | | | |
|---|---|---|---|---|
| 3,444,813 | A * | 5/1969 | Bird | 102/449 |
| 3,847,082 | A * | 11/1974 | Feldmann | 102/522 |
| 3,981,242 | A * | 9/1976 | Shurtleff | 102/454 |
| 4,140,061 | A * | 2/1979 | Campoli | 102/529 |
| 6,779,463 | B2 * | 8/2004 | Mutascio et al. | 102/502 |
| 8,171,838 | B2 | 5/2012 | Heitmann | 102/522 |
| 8,250,988 | B2 | 8/2012 | Heitmann | 86/52 |
| 8,333,153 | B2 * | 12/2012 | Caillat | 102/522 |
| 2012/0144712 | A1 * | 6/2012 | Rostocil | 42/16 |

* cited by examiner

*Primary Examiner* — James S Bergin
(74) *Attorney, Agent, or Firm* — Gerhard W. Thielman Esq

(57) ABSTRACT

An inert axisymmetric projectile is provided for launching from a shipboard gun and dispersing submunitions at a target. The projectile includes a base plug, a sabot housing, a submunitions package, and a retainer ring. The sabot housing includes a plurality of sabot petals angularly arranged and attached to the plug. The housing includes a payload portion and a nose portion, with a passage corridor between these portions. The submunitions package is contained within the payload portion and constrained radially by the housing. The retainer ring constrains the petals for joining together. Upon launch aerodynamic pressure fractures the ring and causes the petals to unfurl, thereby releasing the submunitions package for dispersal.

9 Claims, 21 Drawing Sheets

1700

INERT AND PRESSURE-ACTUATED SUBMUNITIONS DISPENSING PROJECTILE

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to gun-launched projectiles. In particular, this invention relates to submunition-dispensing rounds without incorporation of energetic materials.

As the United States Navy transitions from a "Blue Water" Combat Posture to a "Littoral" Combat Posture, naval warships become more susceptible to attack from non-conventional surface weapon platforms from shore-launched threats, such as coastal boats. The Mk 45-5" 54/62 Gun Mount serves as one of the primary surface warfare weapons aboard these vessels. Although there are multiple 5" (five-inch) diameter projectiles available for use against small boat threats, their fuzing safe and arm devices preclude their use at close ranges.

Additionally, rules of engagement often permit potential small boat threats to enter within the minimum fuzing safe and arm ranges, thus eliminating any potential self-defense contributions from the Mk 45-5" 54/62 caliber Gun Mount. Cruiser CG-47 (USS Ticonderoga) and destroyer DDG-51 (USS Arleigh Burke) class ships employ the Mk 45-5" 54/62 Gun Mount as a primary surface warfare weapon. The Mk 45 5" 54/62 Gun Mount is a fully automated, rifled, single-barrel weapon that stows and fires 5" 54/62-caliber ammunition. The weapon is capable of firing 70-lb projectiles at surface craft, low altitude aircraft, and shore targets.

SUMMARY

Conventional gun-launched projectiles yield disadvantages addressed by various exemplary embodiments of the present invention. Although there are multiple 5" (5-inch) diameter projectiles available for use against small boat threats, their fuzing safe and arm devices preclude their use at close ranges, eliminating any potential self-defense contributions from Mk 45-5" 54/62 Gun Mount. In particular, various exemplary embodiments provide an inert axisymmetric projectile for launching from a shipboard gun and dispersing submunitions at a target.

The projectile features include a base plug, a sabot housing, a submunitions package, a retainer ring, and a slip obturator. The sabot housing includes a plurality of sabot petals angularly arranged and attached to the plug. The housing includes a payload portion and a nose portion, with a passage corridor between these portions. The submunitions package is contained within the payload portion and constrained radially by the housing. The retainer ring constrains the petals for joining together. Upon launch the ring fractures from aerodynamic pressure and rotational forces. This causes the petals to unfurl, thereby releasing the submunitions package for dispersal.

The slip obturator engages the lands and grooves of the barrel rifling and seals the explosive gases behind the projectile, preventing them from advancing further up the projectile and potentially causing damage. The projectile "slips" at the interface between the slip obturator and the base plug, reducing the spin on the projectile that would have otherwise been induced by the barrel rifling. As the projectile progresses down the barrel, the structure of the sabot petals resist undesired deformations under the gun launch loadings of axial inertial setback and rotational inertia. The forward retaining band is restrained from deformation or failure by the radial restraint of the gun barrel itself.

Once the projectile exits the muzzle of the gun, the retaining band is no longer restrained by the barrel and fractures. The band suffers a controlled fracture by means of stress concentrations at geometric cross-section reductions along its circumference due to the combined loadings of axial inertial setback, rotational inertia, and aerodynamic stagnation pressure. Thus, absent restraint at their forward ends, the sabot petals begin to "peal" away from the projectile's central axis due to the centrifugal forces caused by rotation, as well as pressure resulting from petal contact with the ambient air. The petals then discard from the projectile and expose the interior submunitions package. The submunitions immediately begin to disperse radially due to their rotational inertia and their interaction with the ambient air. The dispersed payload is then disposed to engage the intended target. The remaining non-payload projectile components in flight are considered sacrificial materials.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

Figure 1:
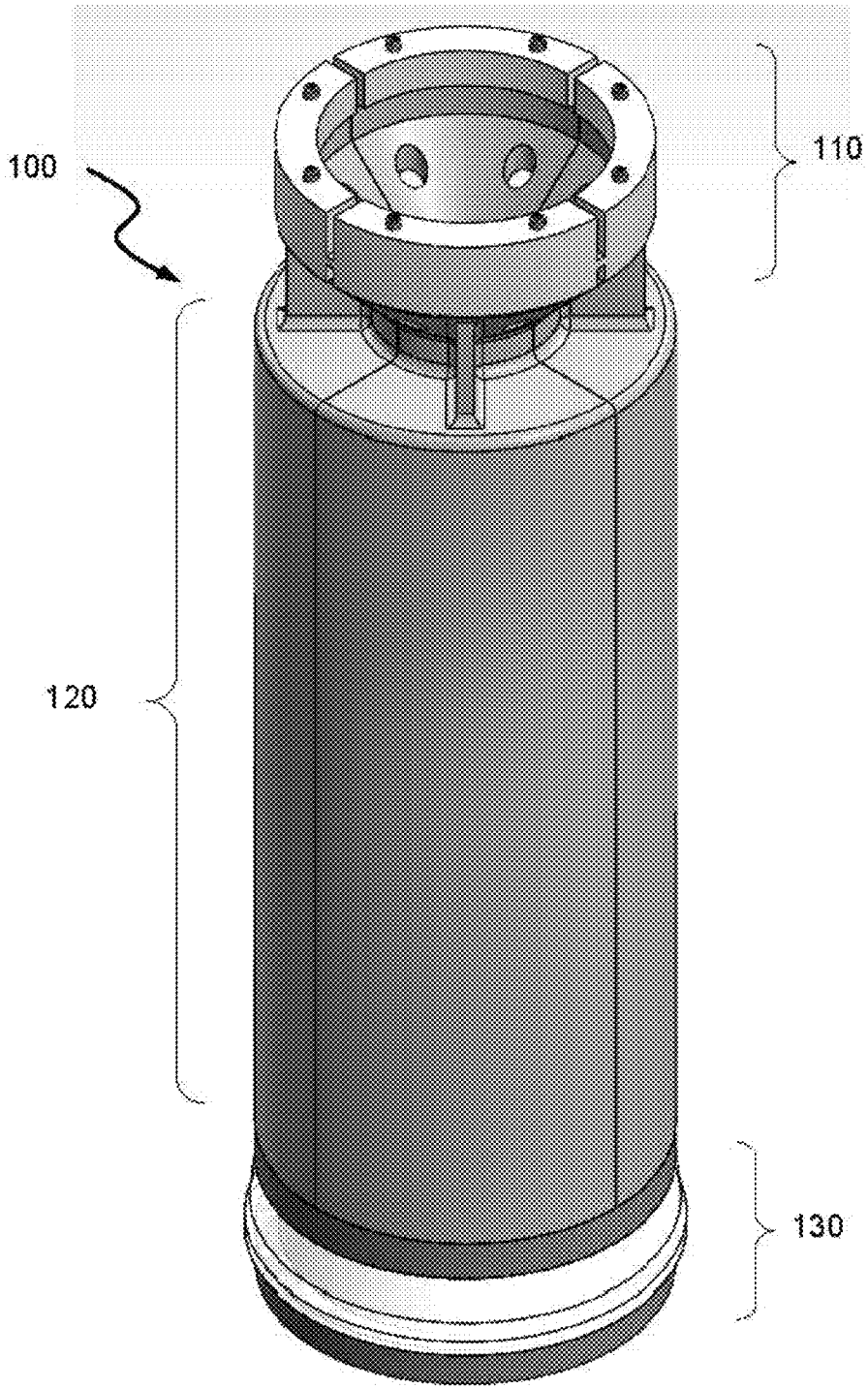
FIG. 1 is an isometric assembly view of an inert gun-launched projectile.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Various exemplary embodiments provide an inert gun-launched projectile actuated by gun-launch induced pressures, or "pressure actuated projectile-inert" (PAPI) for standoff ship defense against proximate threats. The PAPI dispenses an internal payload of multiple fragments over an extended area without the use of a conventional fuze or energetic material. The PAPI uses the propelling gasses and acceleration-induced forces from gun launch to initiate internal mechanisms that release housing petals and dispense an internal payload towards a target.

PAPI is being developed to significantly increase the self-defense capabilities of warships against small, fast, asymmetric watercraft threats. Being inert renders the PAPI more convenient and safer to store, manufacture, and maintain. In this context, the term "inert" means without energetic material, such as an explosive or chemical propellant to disperse submunitions from the projectile upon reaching the target.

The PAPI increases capacity provided to the fleet for proximate ship self defense by providing a near-field projectile to be fired from a 5" (5-inch, e.g., Mk 45) diameter ship-board gun. As such the PAPI constitutes an axisymmetric munitions round. The PAPI is unique less due to its objective, but because of features related to achieving that objective. There are existing "shotgun" type rounds in use by the United States Army. However, these rounds disperse their payloads by means of projectile bodies that shatter apart at or near muzzle exit from the gun.

The PAPI dispenses its payload using mechanisms actuated by gun launch forces. These mechanisms employ controlled fracture of a retaining ring or the channeling of propellant gasses into the interior of the projectile during gun launch. Current research reveals no existing projectile that dispenses a multiple fragment payload by channeling propellant gas to actuate a mechanical device. The novelty of these embodiments can also be extended by the use of a slip obturator to retard spread of the submunitions by reducing spin when fired out of a rifled gun barrel. Exemplary embodiments use the slip obturator to reduce spin (i.e., angular rotation about the PAPI's longitudinal axis) to limit the distribution of the payload to a smaller area. Alternatively, the PAPI can use a regular obturator, thereby achieving full spin, and enabling the round to accurately traverse to the target.

Most shotgun type rounds are fired out of a smoothbore barrel. PAPI can be used on ships wielding large-caliber rifled barrels to engage close range, asymmetric surface threats. The inner spring and pressure actuation mechanism of PAPI can be used for other types and sizes of projectile or as a release mechanism initiated by inertial forces. The principle embodiments described herein include an aerodynamic design and a mechanical design. Each configuration is described in further detail.

Figure 2:
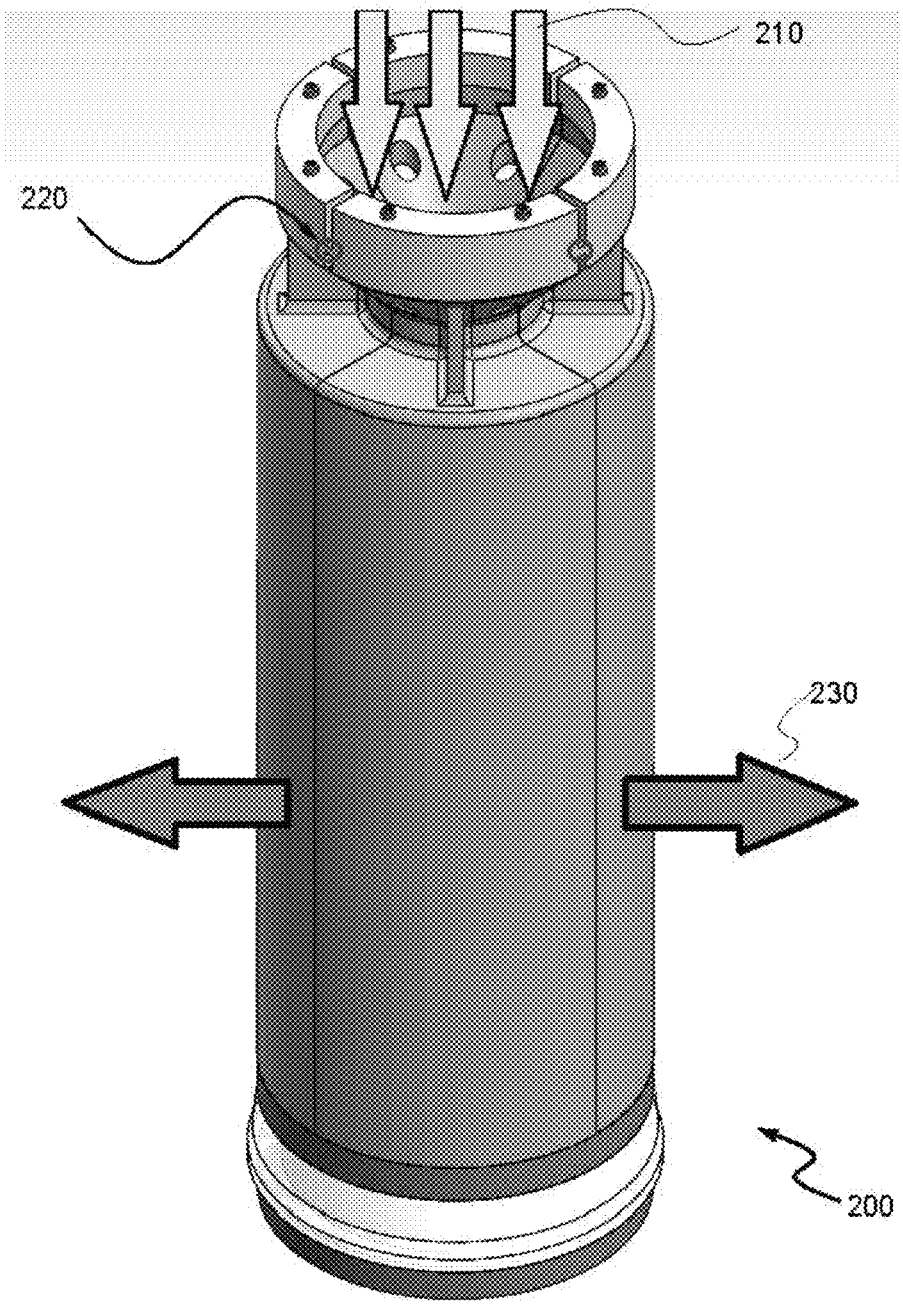
FIG. 2 is an isometric view of aerodynamic forces on the projectile.

FIG. 1 shows an isometric view 100 of a retainer ring PAPI, showing a nose portion 110, a payload portion 120 and a base portion 130. FIG. 2 shows an isometric view 200 of the retainer ring PAPI indicating the direction of aerodynamic forces 210 from forward motion after muzzle exit. These forces 210, in conjunction with rotational inertial forces and axial inertial setback forces, induce circumferential tensile stresses at the joint tabs 220, which induces fracture at an established load. This fracture enables separation of the petals on the nose portion 110 under the centrifugal forces 230 experienced.

Figure 3:
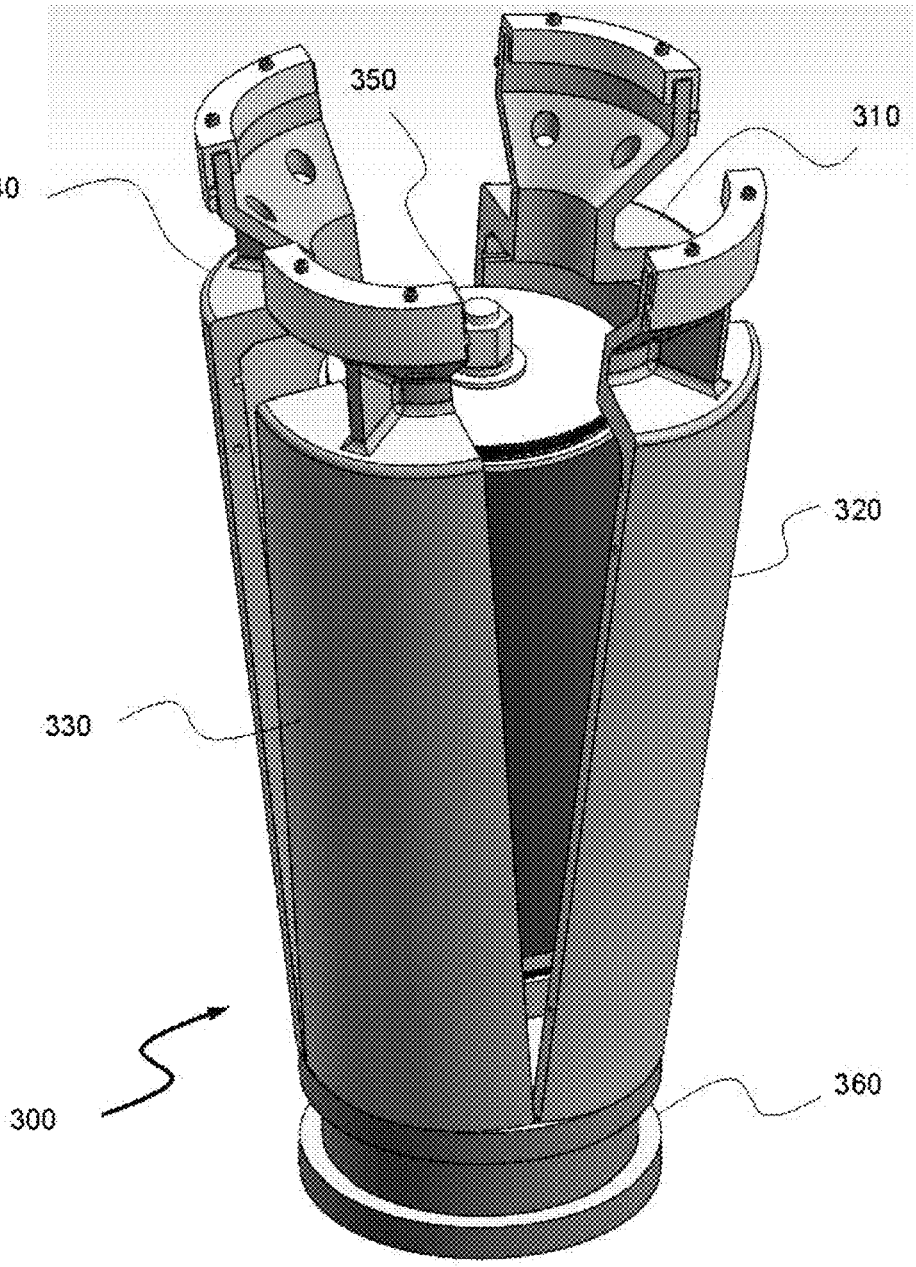
FIG. 3 is an isometric view of the projectile unfolding.

FIG. 3 shows an isometric view 300 of the retainer ring PAPI after severing the joints 220. Four angularly distributed sabot petals, distal 310, starboard 320, proximal 330 and port 340 are depicted in partial separation from a payload assembly 350 that mounts to a base plug 360. Together these petals form a sabot housing and can be composed of an appropriate metal, such as an aluminum 7075 alloy, for example, and have thickness of 15 mils under the bore diameter as is consistent with most 5" projectiles. Artisans of ordinary skill will recognize that the design of four identical petals arranged in angular cruciform configuration is exemplary and other arrangements or numbers of petals can be contemplated without departing from the scope of the invention.

Figure 4:
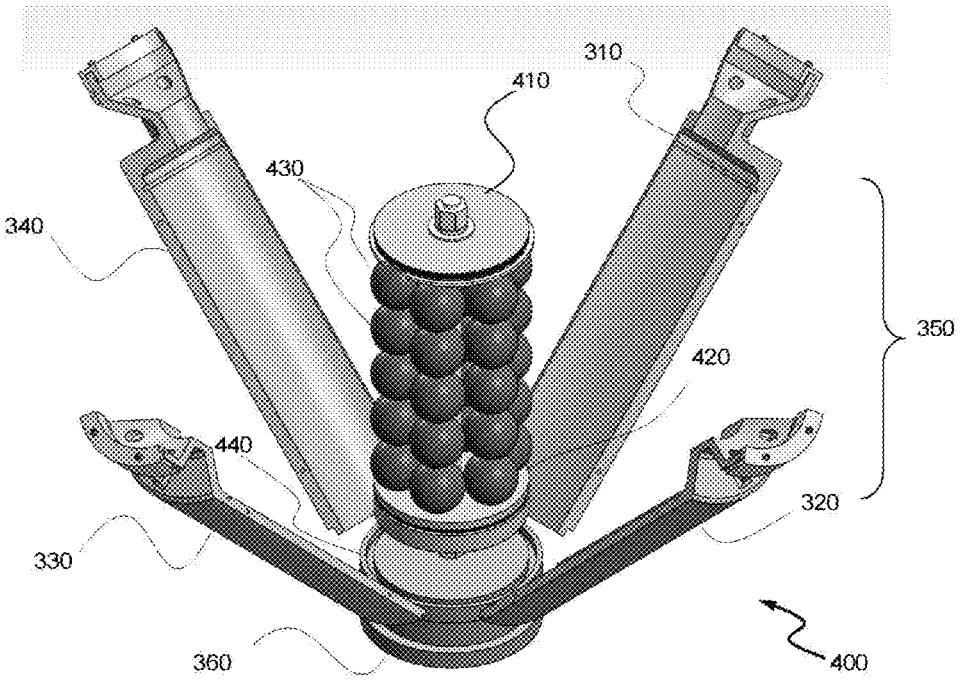
FIG. 4 is an isometric view of the projectile unfurled.

FIG. 4 shows an isometric view 400 of the retainer ring PAPI with the petals 310, 320, 330 and 340 having pealed away from the base plug 360, thereby exposing the payload assembly 350. An upper bulkhead or plate 410 and a lower bulkhead or plate 420 together axially constrain pellets or balls 430, which are also radially constrained by the petals until sabot separation. The plates 410 and 420 are composed preferably of aluminum alloy.

Figure 5:
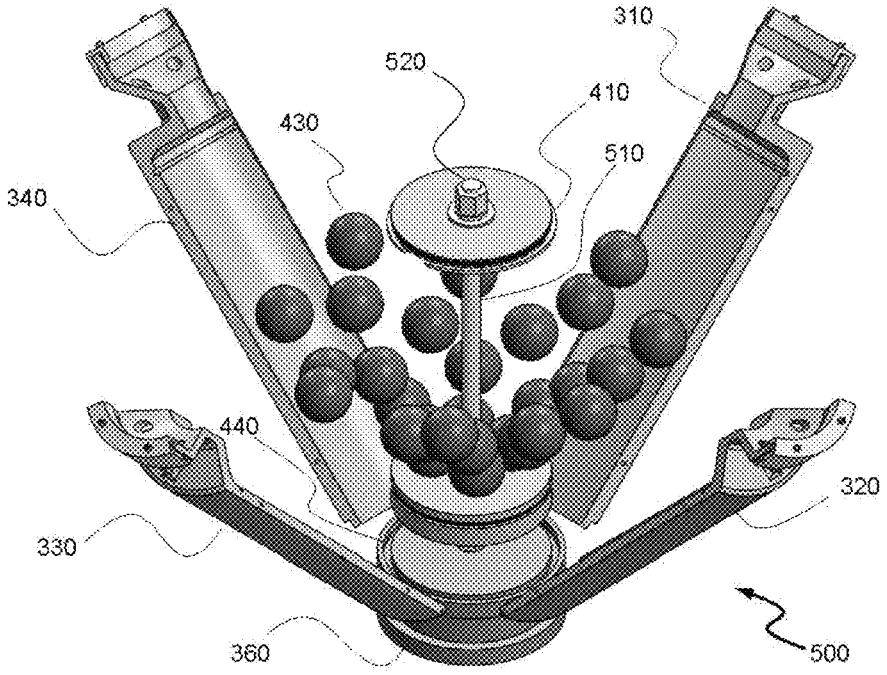
FIG. 5 is an isometric view of the projectile with dispersal of submunitions.

Exemplary balls 430 can be composed of a dense metal, such as ⅜ (0.375 inch) diameter tungsten spheres. The base plug 360 features an angular groove 440 for receiving bottom edges of the petals. FIG. 5 shows an isometric view 500 of the retainer ring PAPI showing the balls 430 in dispersal and revealing a rod 510 connecting the upper and lower plates 410 and 420 and the base plug 360. The rod 510 can be a ½-20 piece of all-thread shaft. The plates 410 and 420 can be secured by ½ (half-inch) hex nuts 520 (and accompanying flat washers) near the ends of the rod 510.

Figure 6:
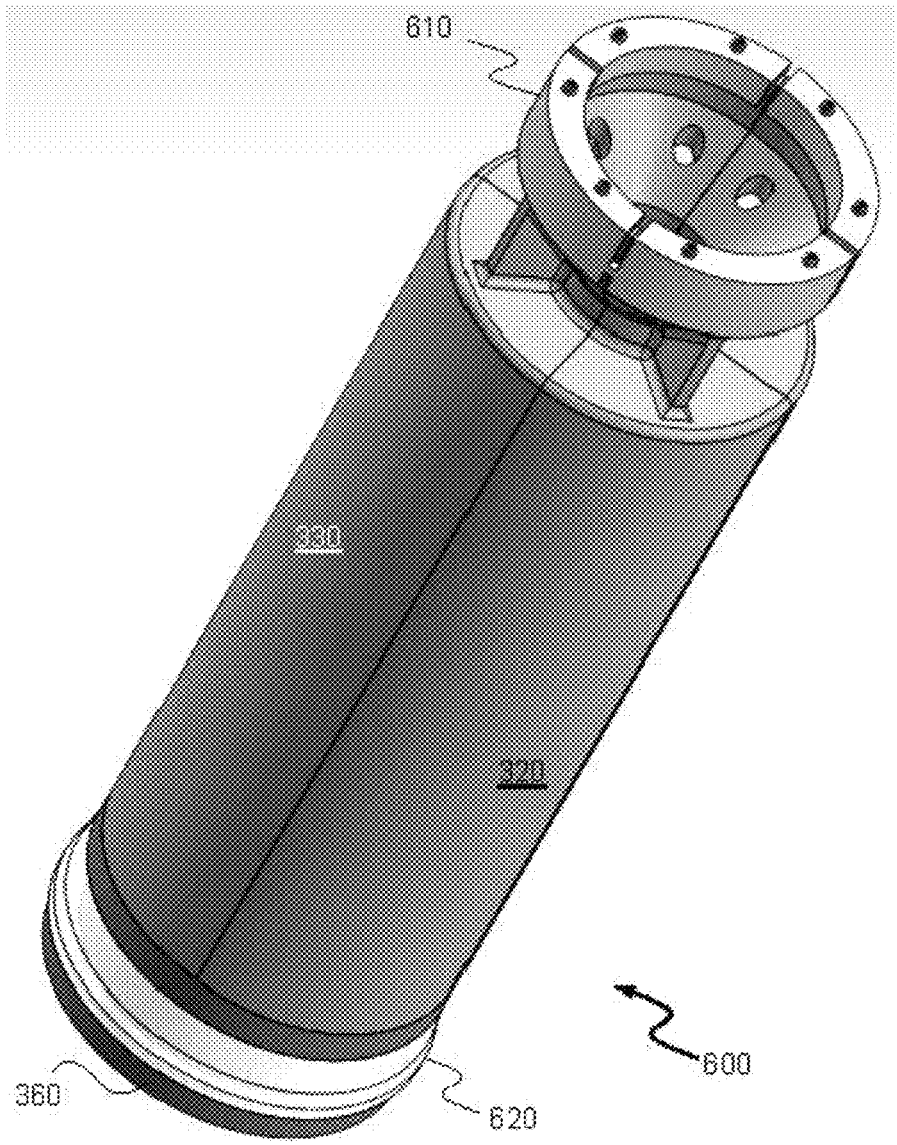
FIG. 6 is an isometric assembly view of the projectile.
Figure 7:
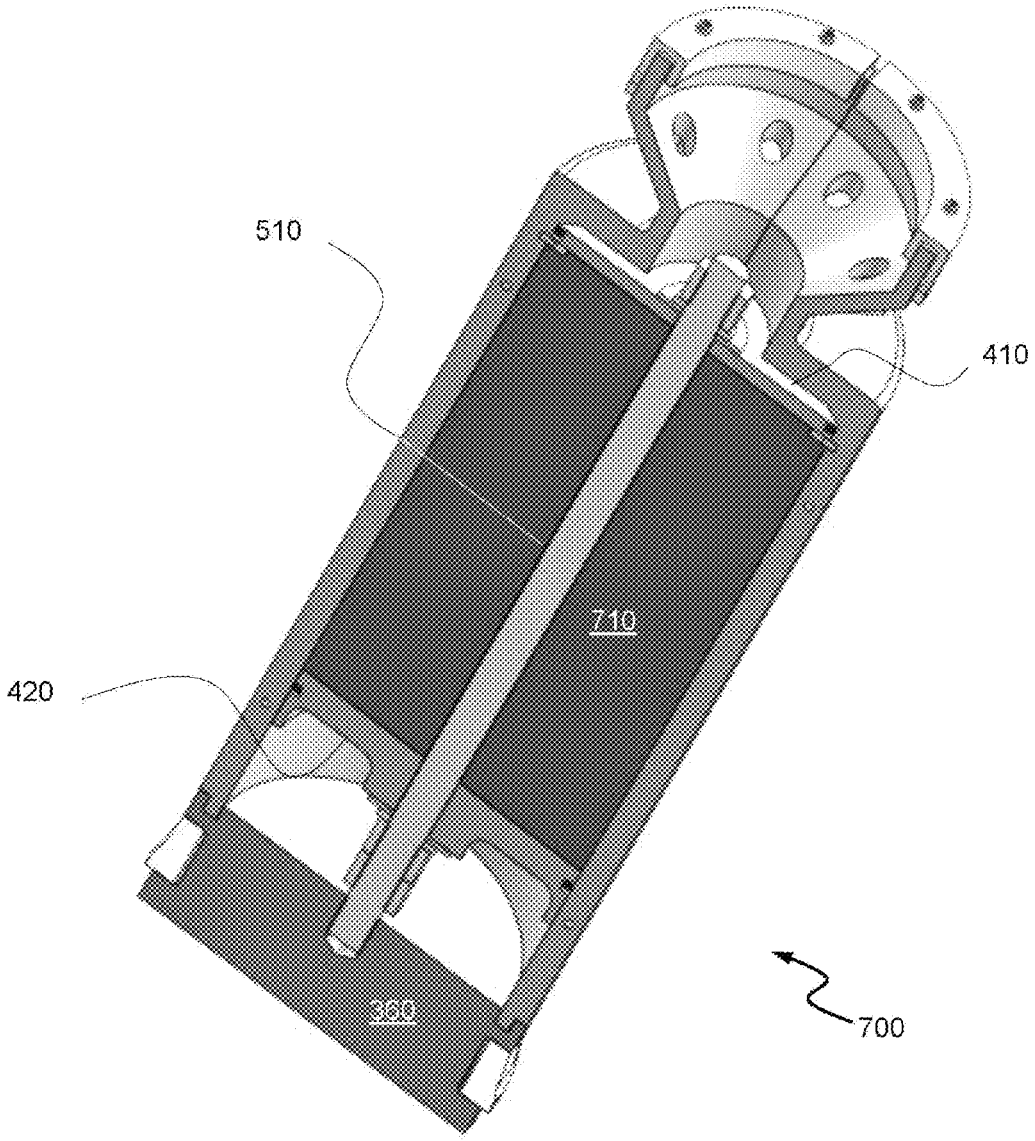
FIG. 7 is an isometric cross-section view of the projectile.

FIG. 6 shows an isometric assembly view 600 of the retainer ring PAPI, similar to the view 100, denoting a severable retainer ring 610, the envelope petals, with starboard 320 and proximal 330 in the foreground, and the base plug 360 combined with an annular band or slip obturator 620. The combination of the base plug 360 and the obturator 620 represents the base portion 130. FIG. 7 shows an isometric cross-section view 700 of the retainer ring PAPI revealing the structural interior. A payload 710 can be disposed around the rod 510, flanked by the upper and lower plates 410 and 420. The payload 710 can comprise about 2800 balls 430 or other dispersing content for a weight of approximately 50 pounds-mass.

Figure 8:
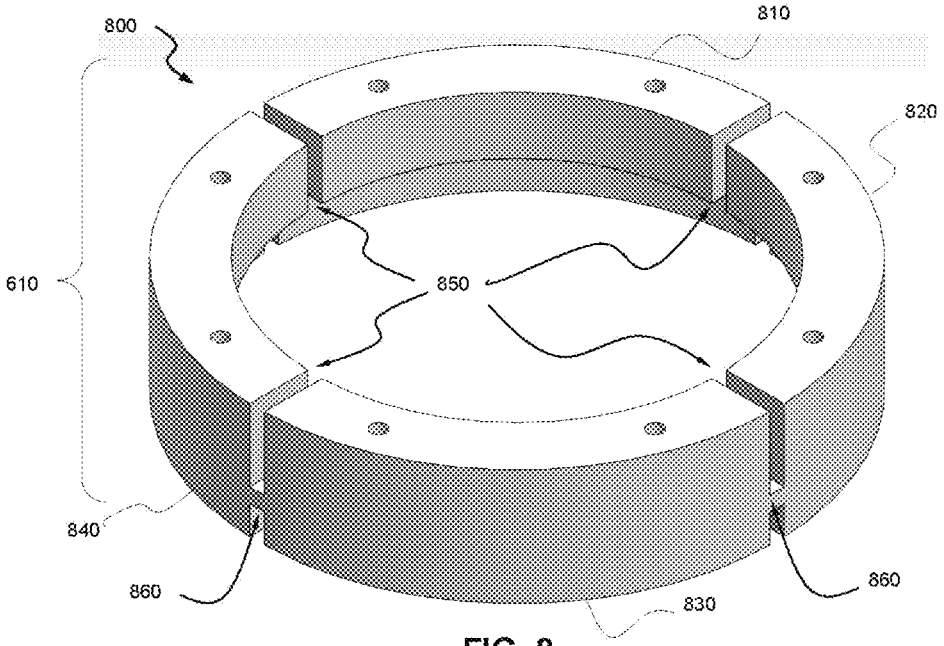
FIG. 8 is an isometric view of a retainer ring for nose installation.

FIG. 8 shows an isometric view 800 of the retainer ring 610, divided evenly into four angular segments and composed of 1020 steel. The ring 610 includes distal 810, starboard 820, proximate 830 and port 840 segments, separated by radially penetrating cuts 850 and held together with angular bridges 860 that correspond to the stress concentration tabs 220. For a 5" diameter projectile, each bridge 860 can be ⅜ wide.

Figure 9:
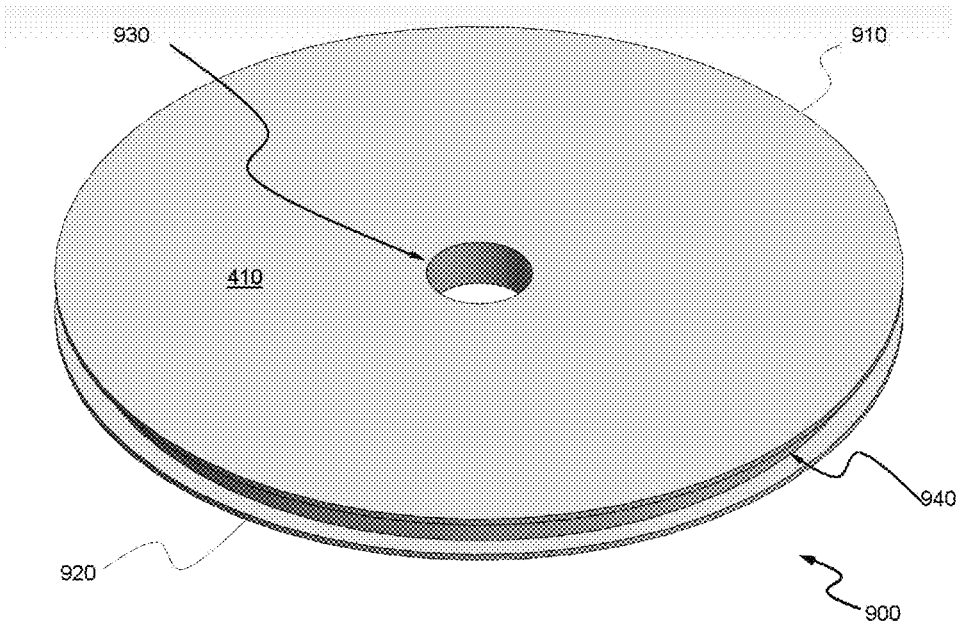
FIG. 9 is an isometric view of an upper plate.

FIG. 9 shows an isometric view 900 of the upper plate 410, which includes an outer disk 910 and an inner disk 920 and penetrated by a center through-hole 930 along the PAPI longitudinal axis. The outer and inner disks 910 and 920 form a radial groove 940 can contain an o-ring, which serves as an environmental seal for the submunition package area.

Figure 10:
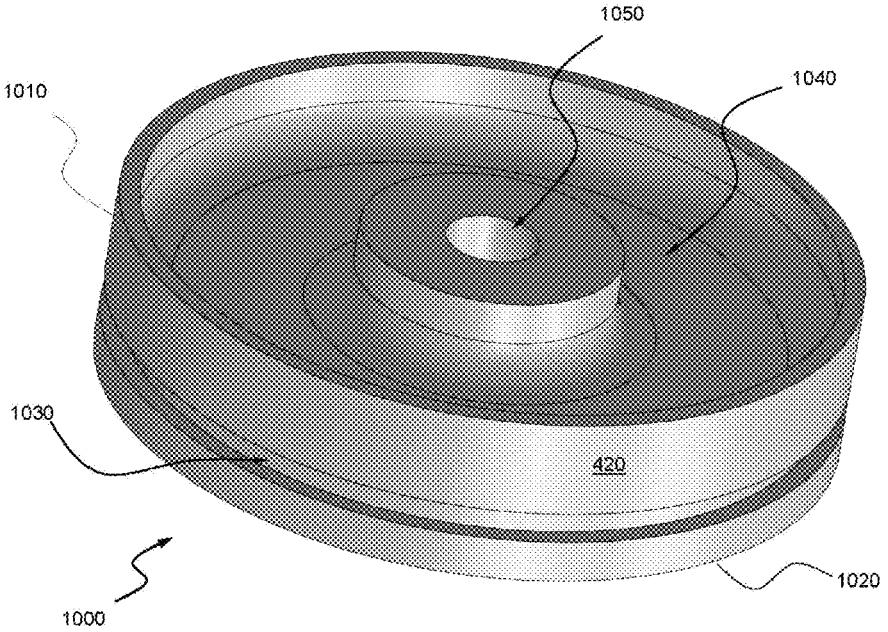
FIG. 10 is an isometric view of a lower plate.

FIG. 10 shows an isometric view 1000 of the lower plate 420, which includes an inner payload annular cap 1010 and an outer flange 1020 with a radial groove 1030 therebetween. The cap 1010 forms an annular cavity 1040. The lower plate 420 includes a center through-hole 1050 along the axis. The rod 510 passes through the holes 930 and 1050.

Figure 11A:
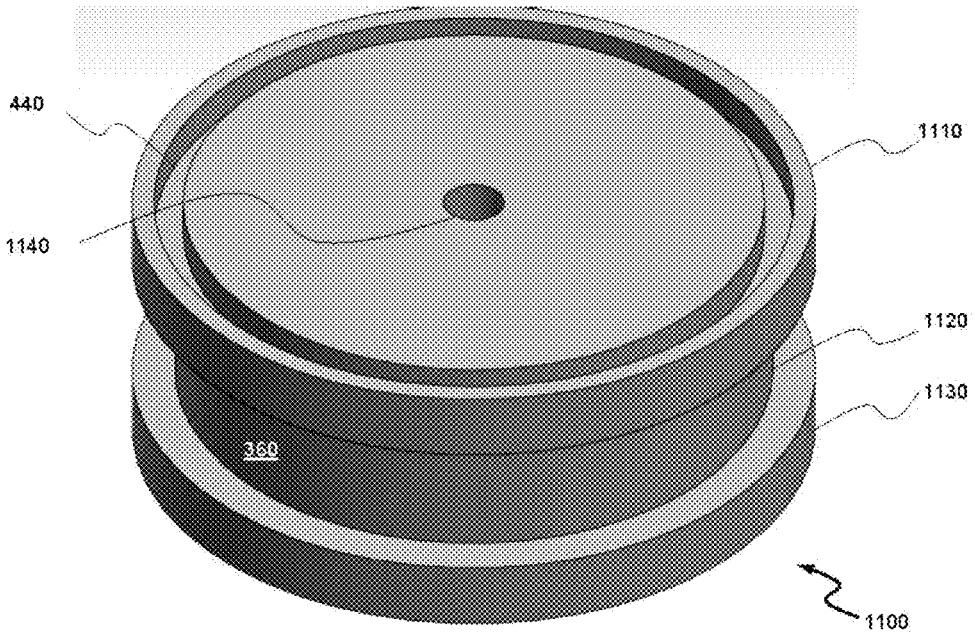
FIGS. 11A and 11B are isometric views of a base plug.
Figure 11B:
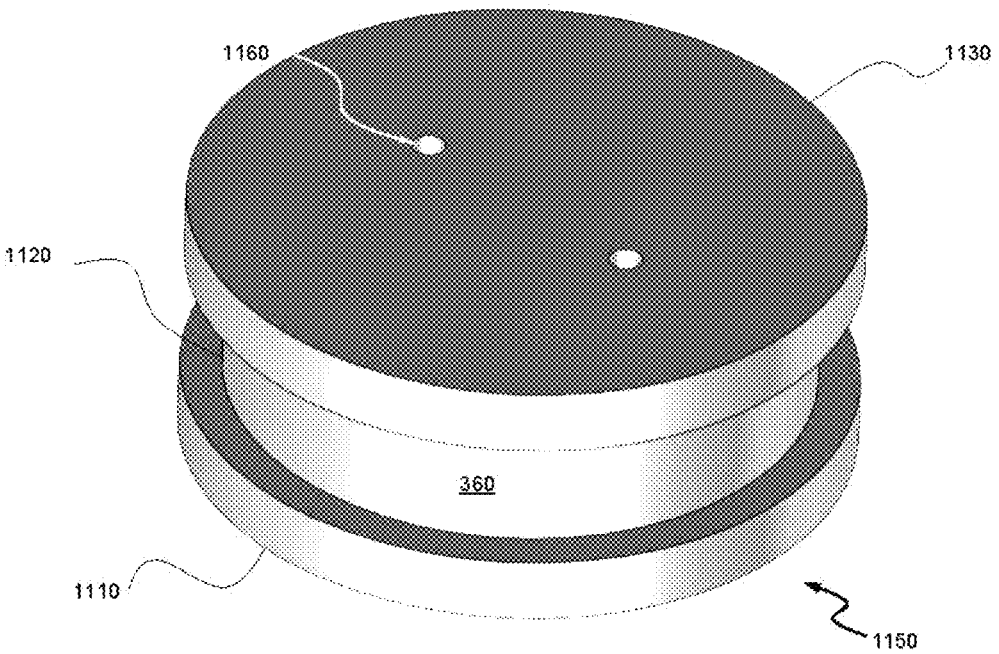

FIG. 11A shows an upper isometric view 1100 of the base plug 360. An inner flange 1110, a mezzanine channel 1120 and an outer flange 1130 form the base plug 360. The inner flange 1110 includes the angular groove 440 and a central hole 1140 to receive the rod 510. FIG. 11B shows a lower isometric view 1150. The outer flange 1130 includes a pair of holes 1160 for receiving a spanner wrench during assembly.

Figure 12:
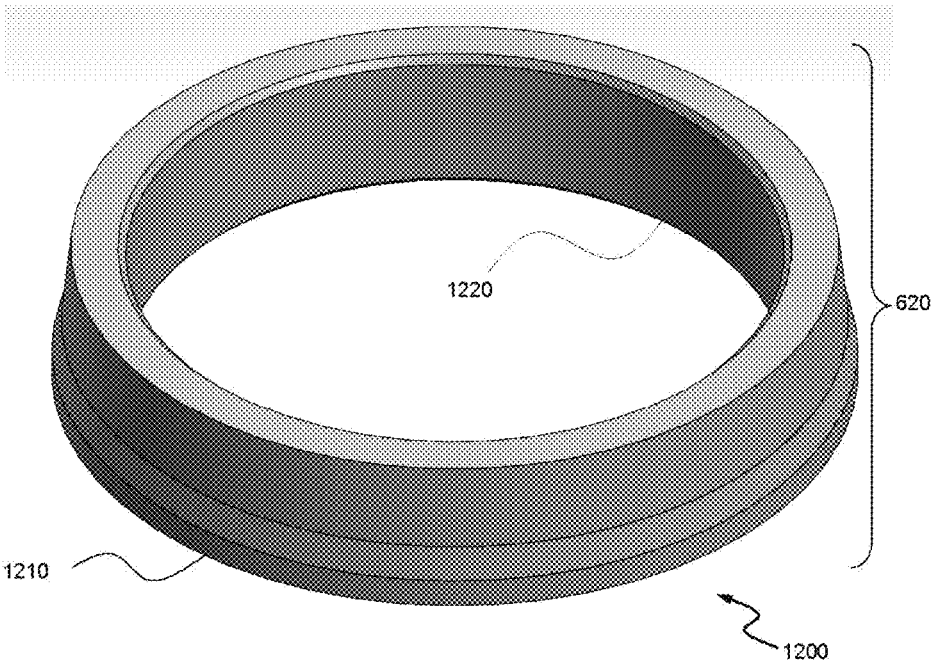
FIG. 12 is an isometric view of a slip obturator.

FIG. 12 shows an isometric view 1200 of the slip obturator 620, which features an outer annular portion 1210 and an inner annular portion 1220 that engages the mezzanine channel 1120. The slip obturator 620 is preferably machined from nylon and serves as an engagement surface for the rifling, effectively sealing propellant gasses behind the gun barrel from the projectile and ensuring maximum transfer to the projectile.

Figure 13:
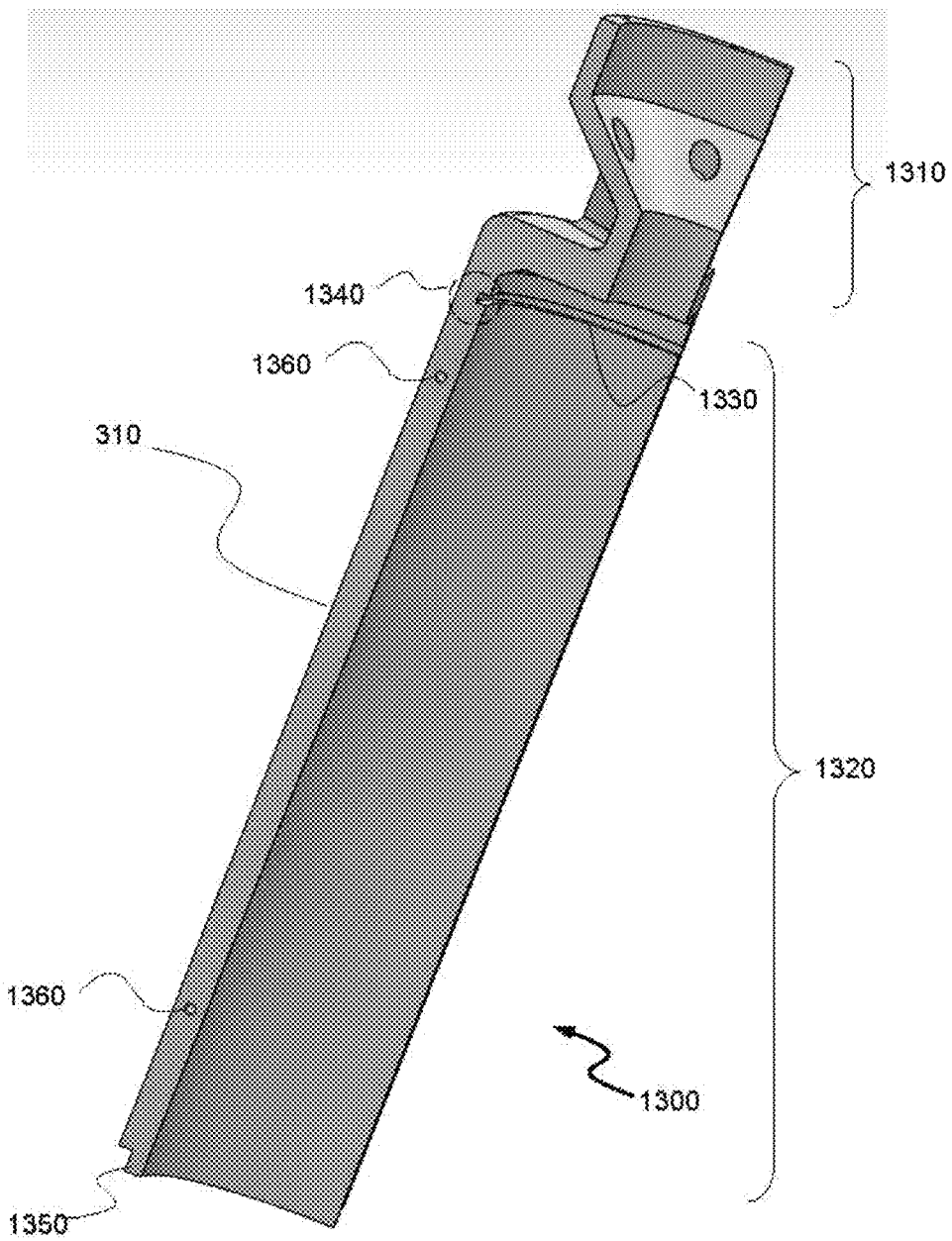
FIG. 13 is an isometric view of a sabot petal.

FIG. 13 shows an isometric view 1300 of the distal petal 310, identical to and interchangeable with the others. A nose segment 1310 (forming part of the nose portion 110) connects to a payload envelope segment 1320 separated by an inner radial groove 1330 having a rectangular cross-section 1340 to restrain the inner disk 920 along its exterior rim. An annular tang 1350 protrudes longitudinally from the envelope segment 1310 to engage the angular groove 440 in the base plug 360. Dowel pins 1360 within the thickness of the petal 310 provide frictional adherence to neighboring petals 320 and 340. For the four-petal cruciform configuration, the eight or twelve dowel pins 1360 are preferably 3/16" diameter.

Figure 14A:
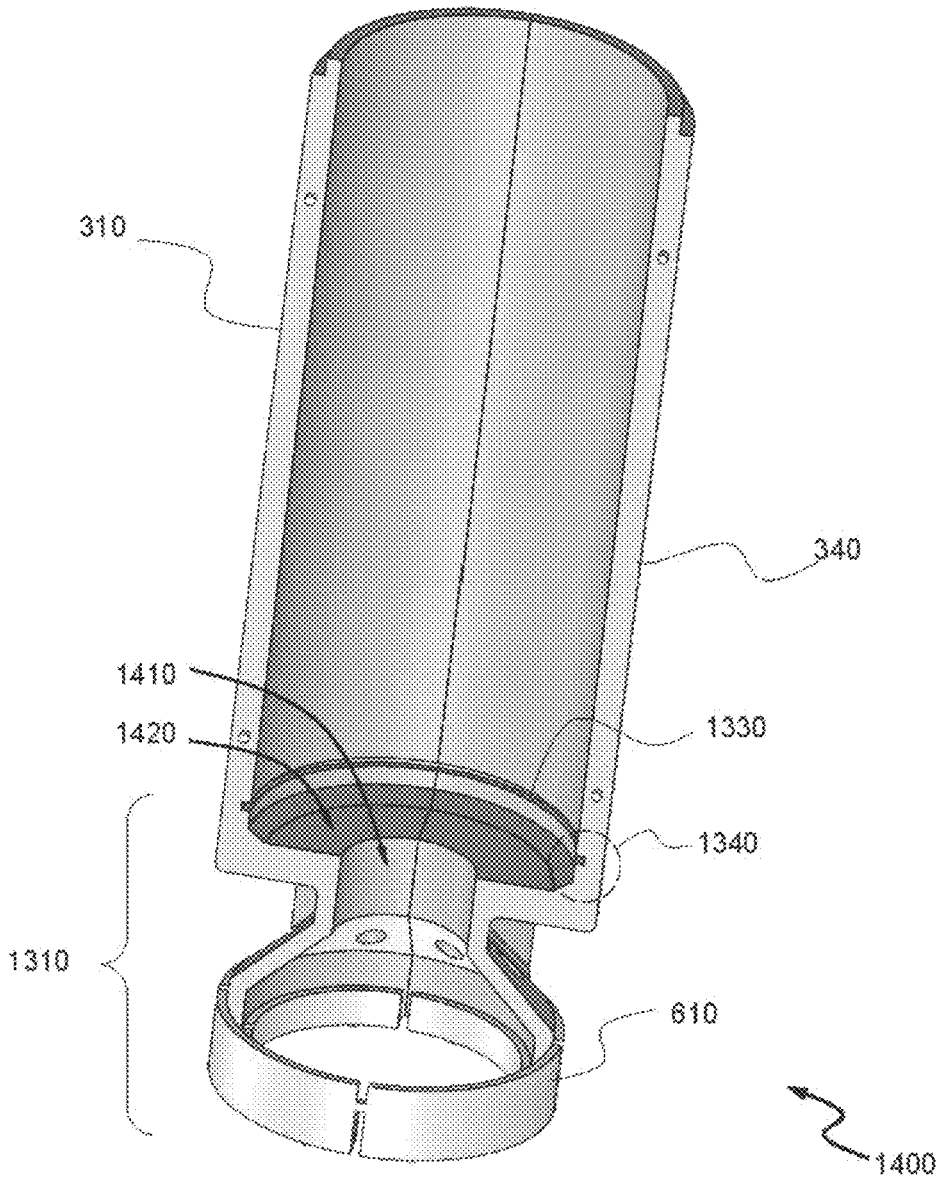
FIGS. 14A through 14F are isometric views of the projectile in stages of assembly.

Assembly of the retainer ring PAPI can be described in the following illustrations. FIG. 14A shows an inverted isometric view 1400 of a pair of petals, specifically distal 310 and port 340 combined together. The retainer ring 610 joins the nose segments 1310 of the petals. Each petal includes an annular arc 1410. Joining the arcs 1410 by assembly of the petals into the sabot housing enables access to the rod 510 and nuts 520 (along with accompanying flat washers) for assembly. An annular ledge 1420 forms an upper boundary to the payload portion 130.

Figure 14B:
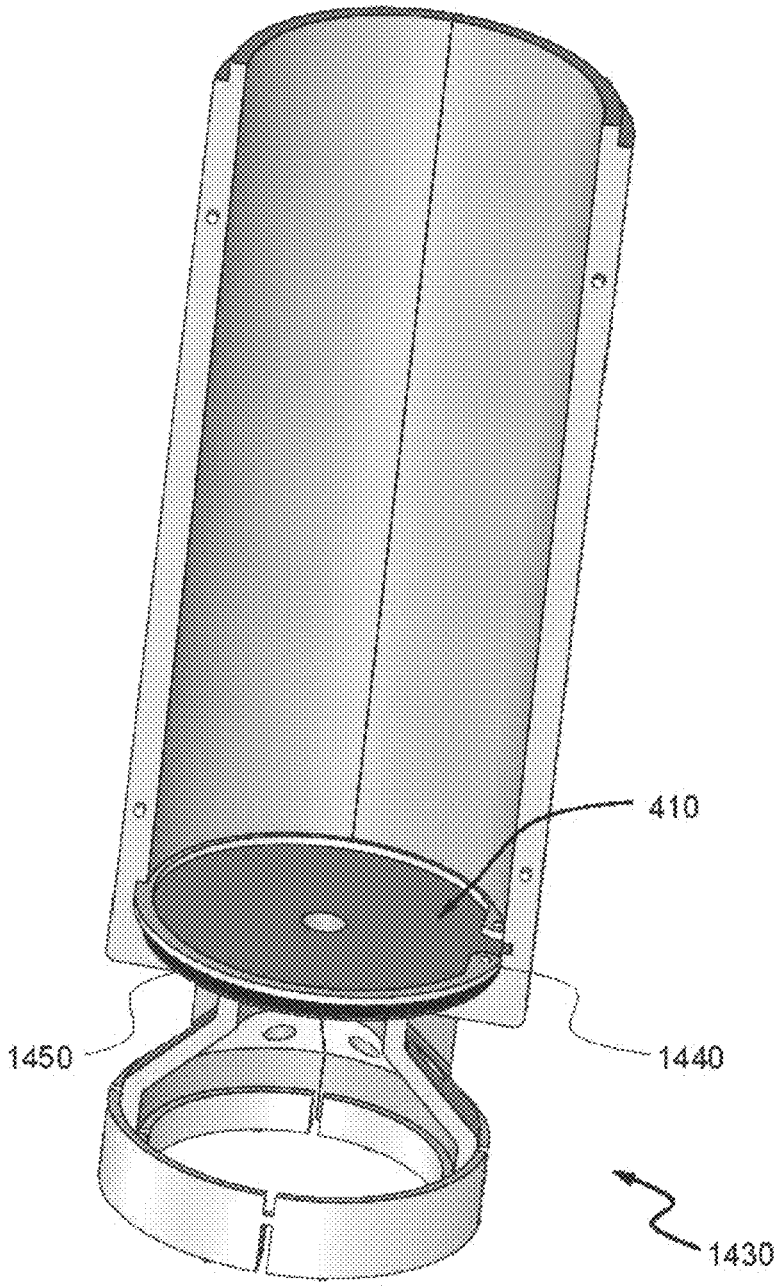
Figure 14C:
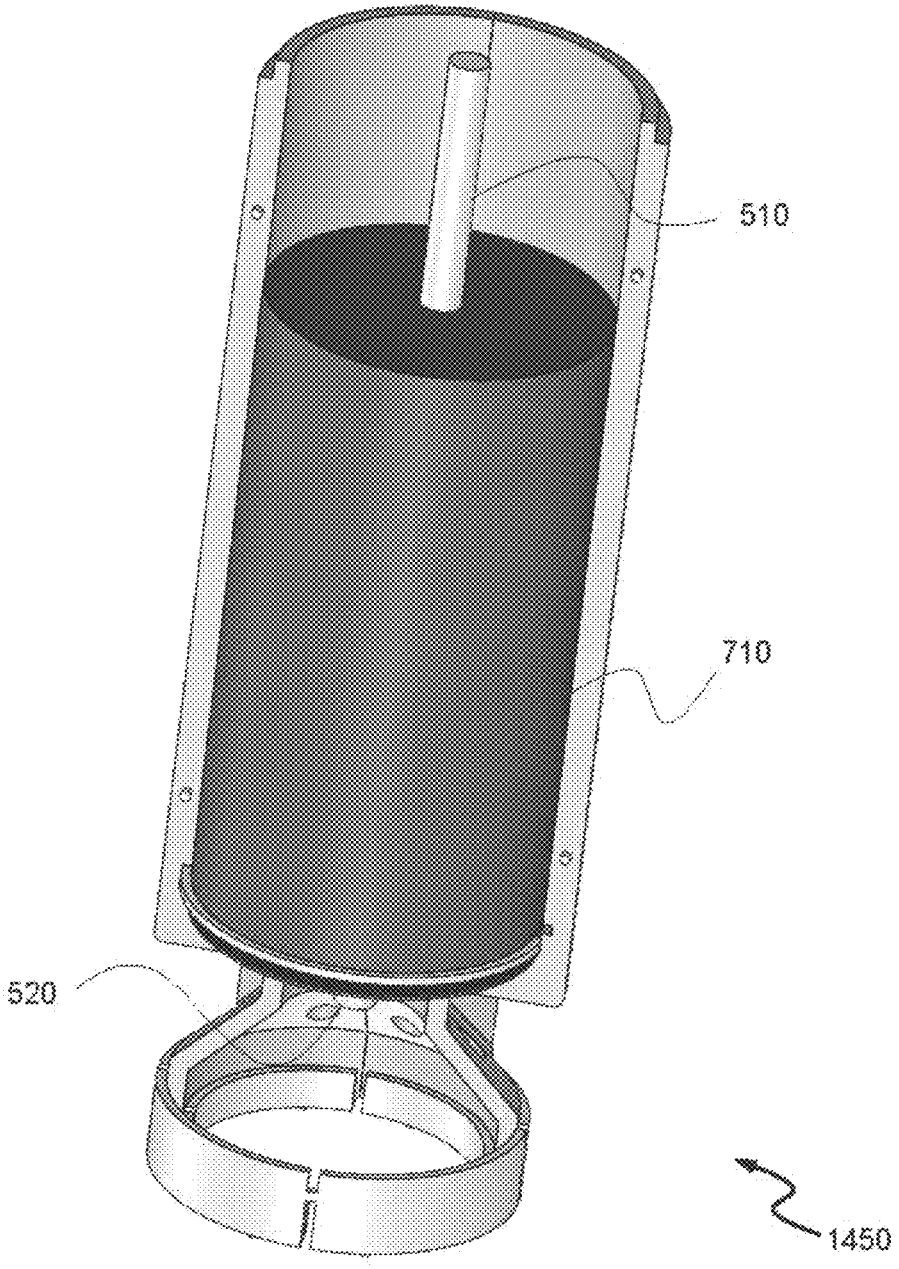

FIG. 14B shows an inverted isometric view 1430 of the petals 310 and 340 with the retainer ring 610 and further including the upper plate 410 with securing snap ring 1440 installed within the radial groove 1330. An o-ring 1450 is disposed within the groove 940 of the plate 410. FIG. 14C shows an inverted isometric view 1450 including the payload 710 and the rod 510 installed in the PAPI assembly. Note that the payload assembly 350 comprises the payload 710 and the rod 510 flanked by the plates 410 and 420.

Figure 14D:
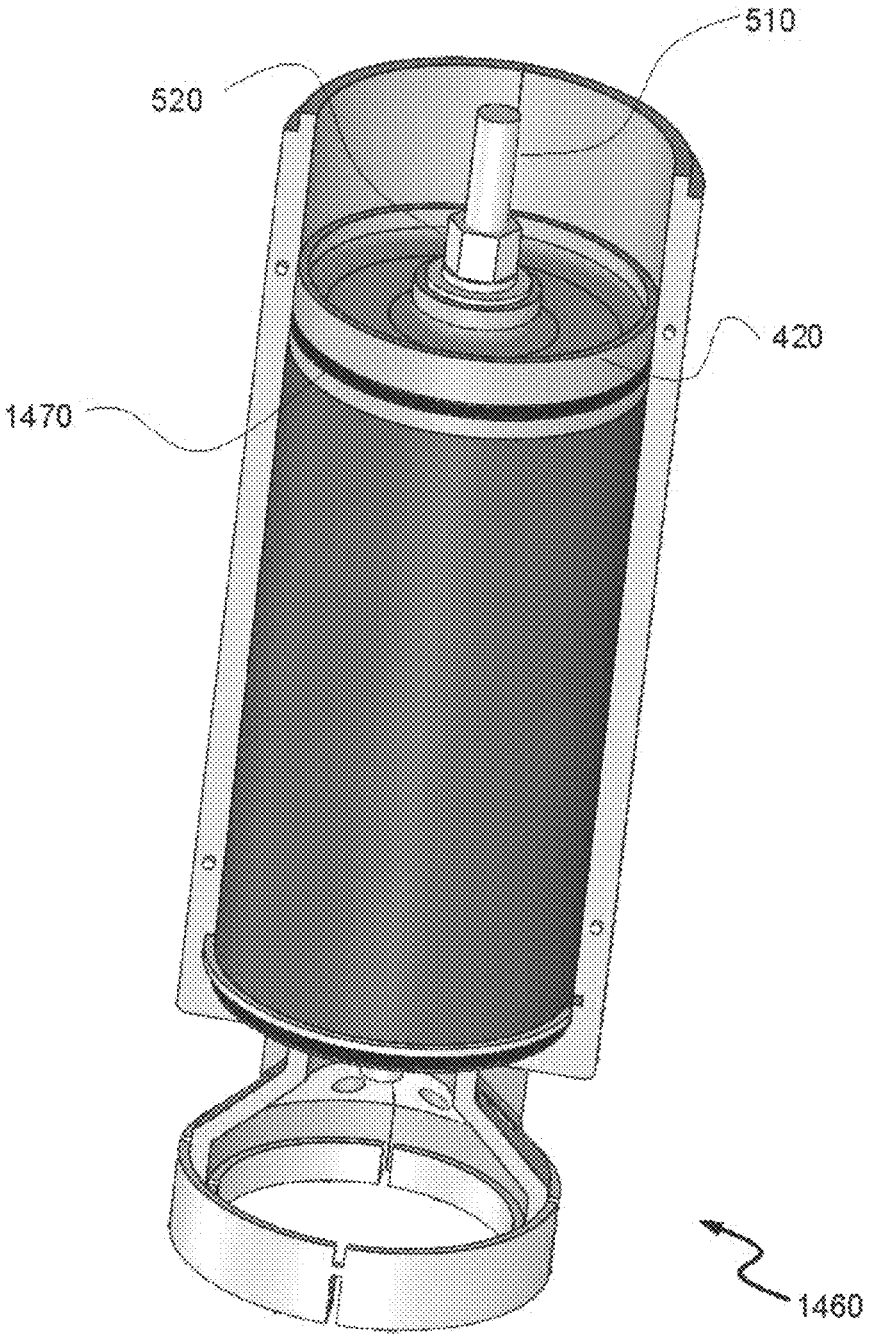
Figure 14E:
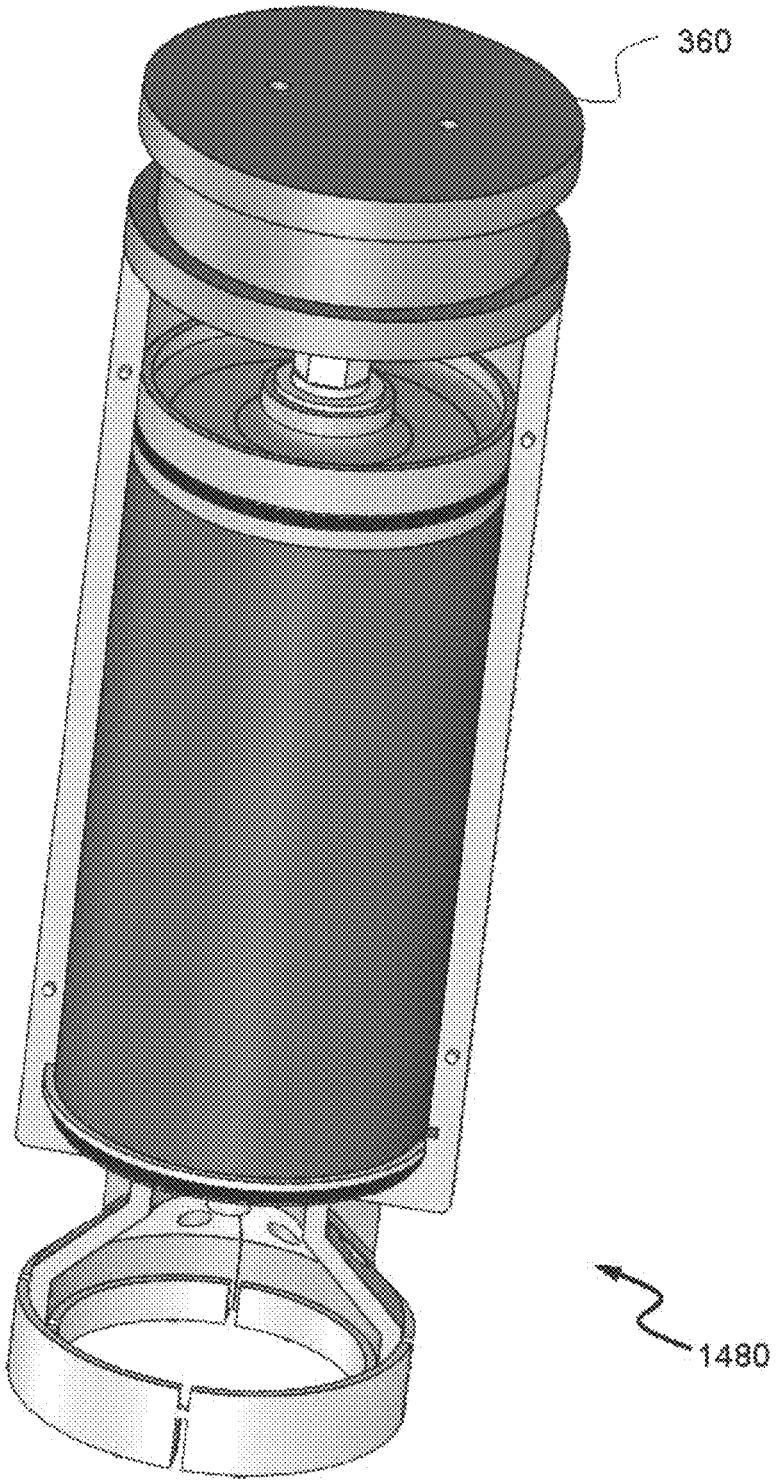
Figure 14F:
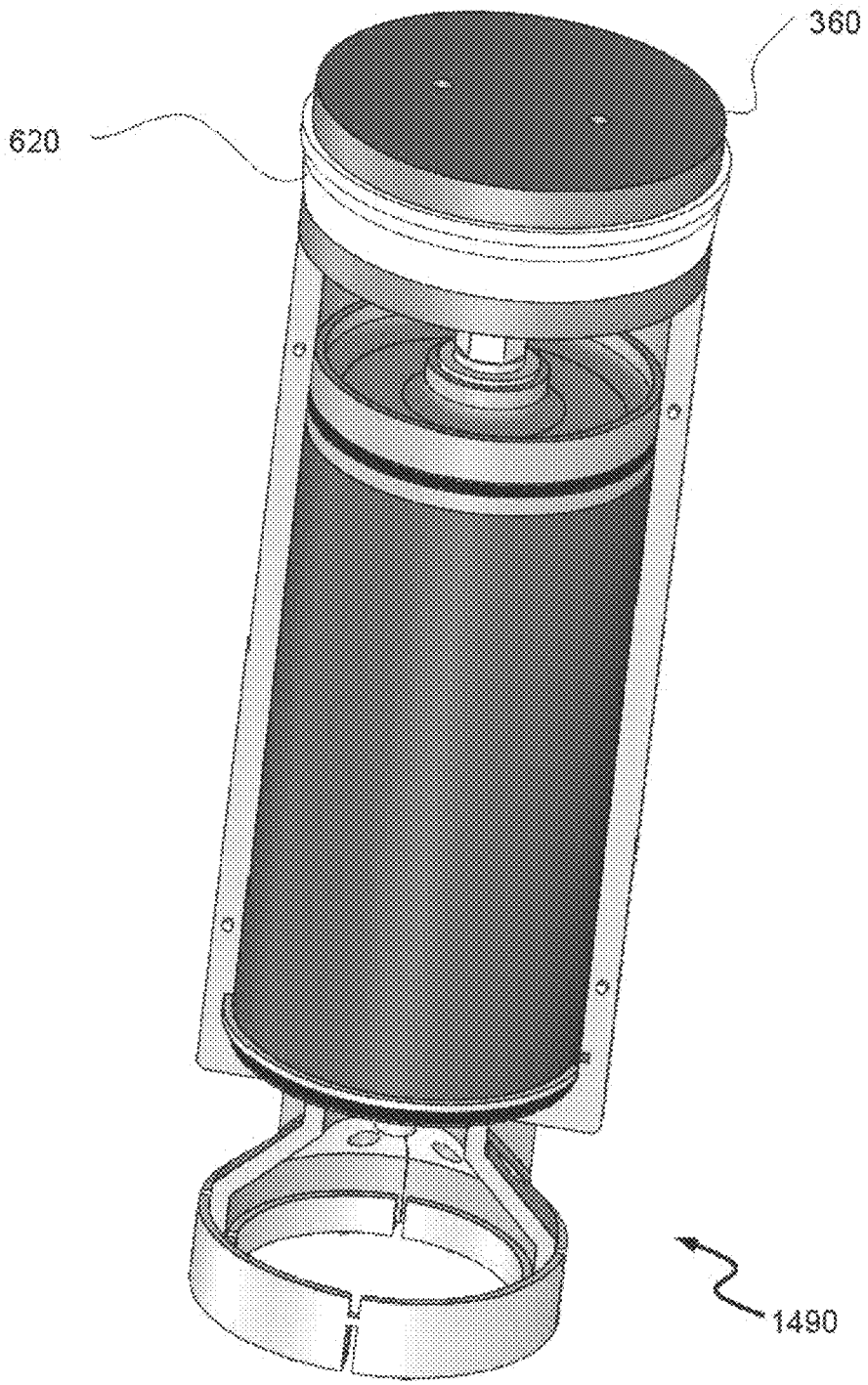

FIG. 14D shows an inverted isometric view 1460 including the lower plate 420 and the nut 520 on the rod 510. The radial groove 1030 receives an o-ring 1470 as an environmental seal to protect the payload 710. FIG. 14E shows an inverted isometric view 1480 including the base plug 360 mounted on the tangs 1350 of the petals. FIG. 14F shows an inverted isometric view 1490 showing the slip obturator 620 wrapped around the base plug 360. The PAPI assembly can be constructed in such manner, with of course all the petals 310, 320, 330 and 340 joined together.

Figure 15:
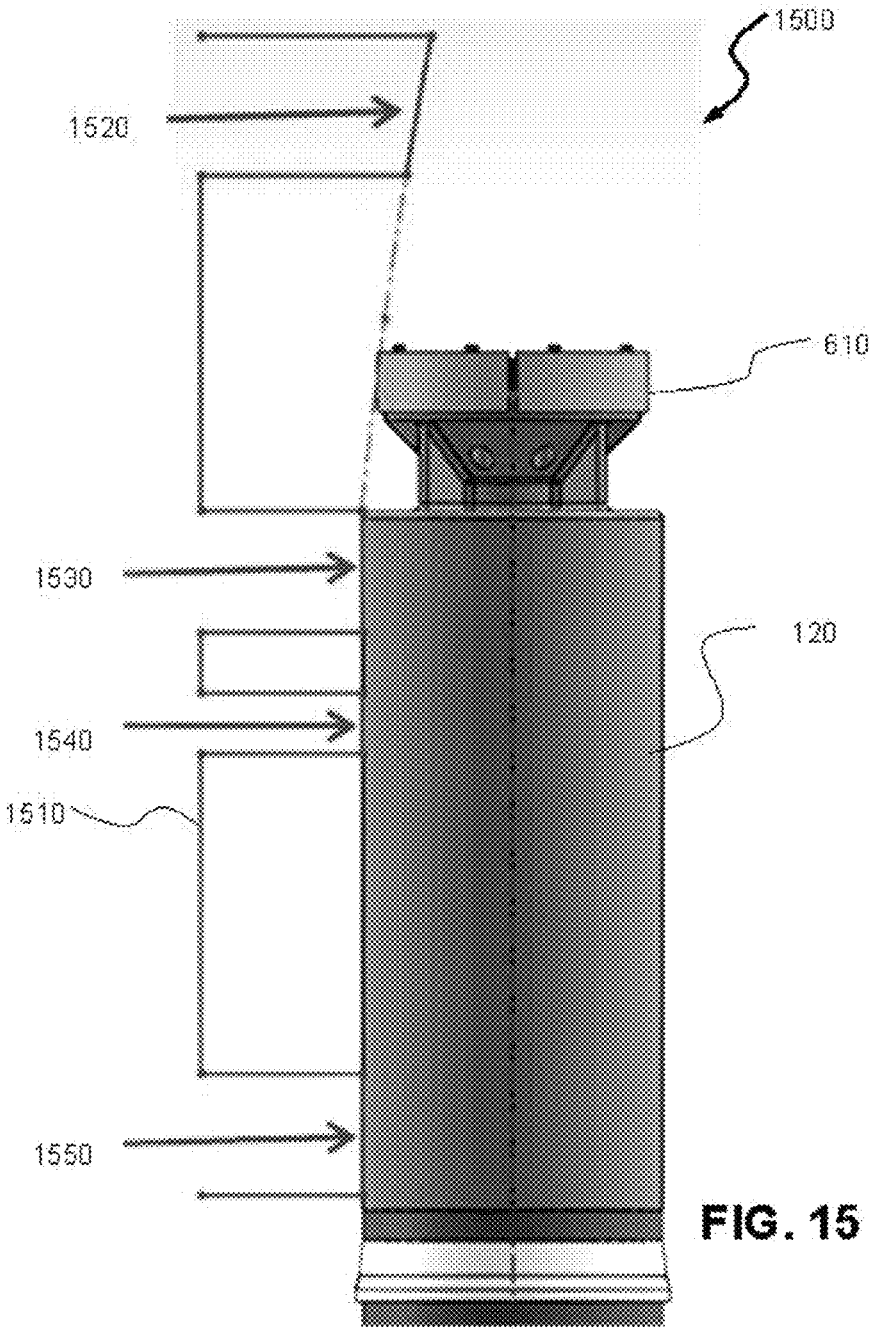
FIG. 15 is an elevation view of the projectile with envelope superimposed.

In order for the PAPI to be used effectively in the fleet, the interface with the Mk 45 Gun Mount's loading system should be considered. FIG. 15 shows an elevation view 1500 of the PAPI with the payload portion 120 and the ring 610. An axisymmetric outline 1510 provides an envelope of the common contact points within the Mk 45-Mod4 projectile autoloader system. An ogive slope line 1520 provides reference to an in-service Mk 64 projectile body's interfaces with the projectile guides in the Mk 45-Mod4 autoloader system. A vertical line 1530 provides reference to the contact point of the upper projectile ram in the Mk 45-Mod4 autoloader system. A vertical line 1540 provides a reference to the contact point of a physical depression sensor in the Mk 45-Mod4 autoloader system. A vertical line 1550 provides reference to the contact point of the lower projectile frame in the Mk 45-Mod4 autoloader system.

Figure 16A:
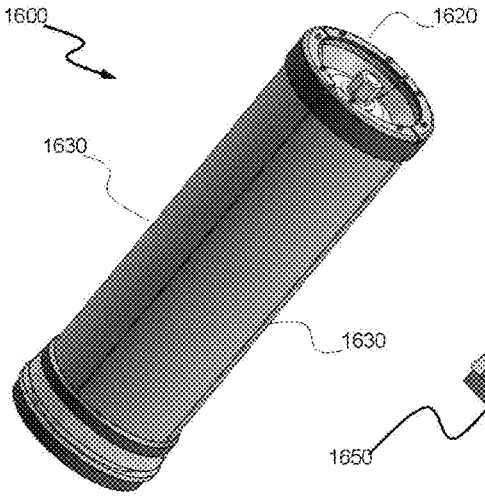
FIGS. 16A and 16B are isometric assembly and cross-section views of an alternate projectile configuration.
Figure 16B:
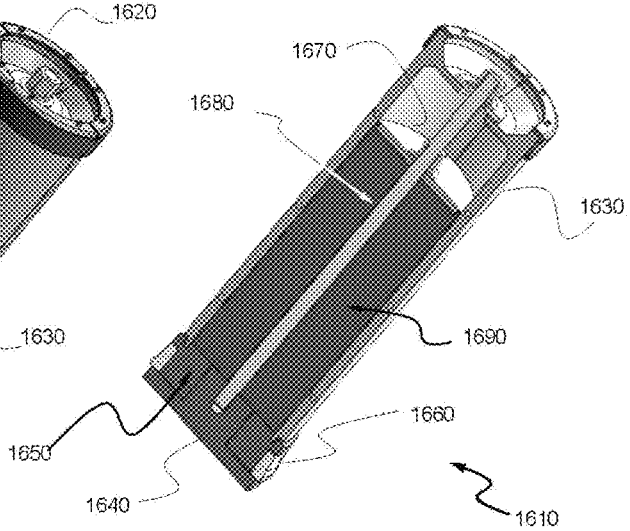

FIGS. 16A and 16B show respective isometric assembly and cross-section views 1600 and 1610 of an alternative PAPI configuration. A retainer ring 1620 restrains a cruciform set of four sabot petals 1630 mounted to a base plug 1640 attached by a base plate 1650. A slip obturator 1660 provides a radial surface for sealing hot gases from gun launch while traversing the muzzle. An upper plate 1670 and the base plate 1650 connected to a rod 1680 constrain a payload 1690, such as the tungsten balls 530 in a submunitions payload package.

Figure 17:
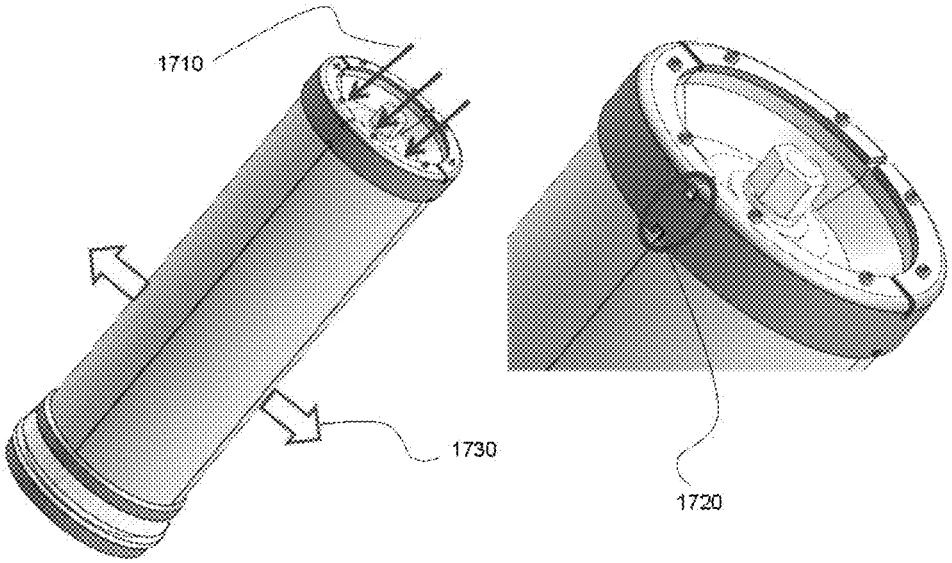
FIG. 17 is an isometric view of aerodynamic forces on the projectile.

FIG. 17 shows isometric general and detail views 1700 of an alternative PAPI. Aerodynamic stagnation pressure 1710 (analogous to 210) coupled with the gun-launch induced rotational inertia and axial inertial setback provide tensile stress to tabs 1720 (analogous to the tabs 220) on the ring 1620, causing the tabs to fracture. The forces of rotational inertia and axial setback 1730 (analogous to the forces 230) then cause the petals 1630, no longer restrained, to unfurl. The payload 1690 is then unrestrained and free to disperse on a target under its own rotational inertia, as well as aerodynamic reactions with the ambient air.

Figure 18A:
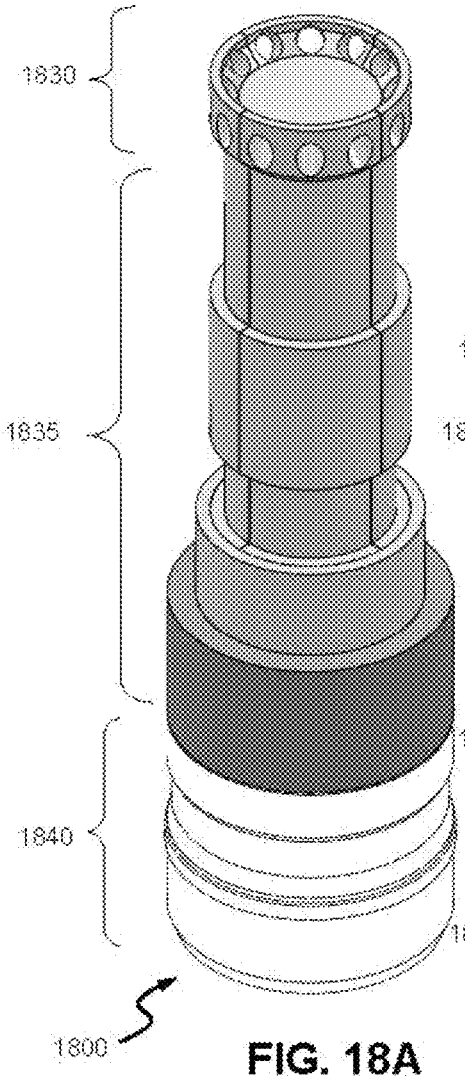
FIGS. 18A through 18C are isometric assembly, isometric cross-section and isometric detail views of another alternate projectile configuration.
Figure 18B:
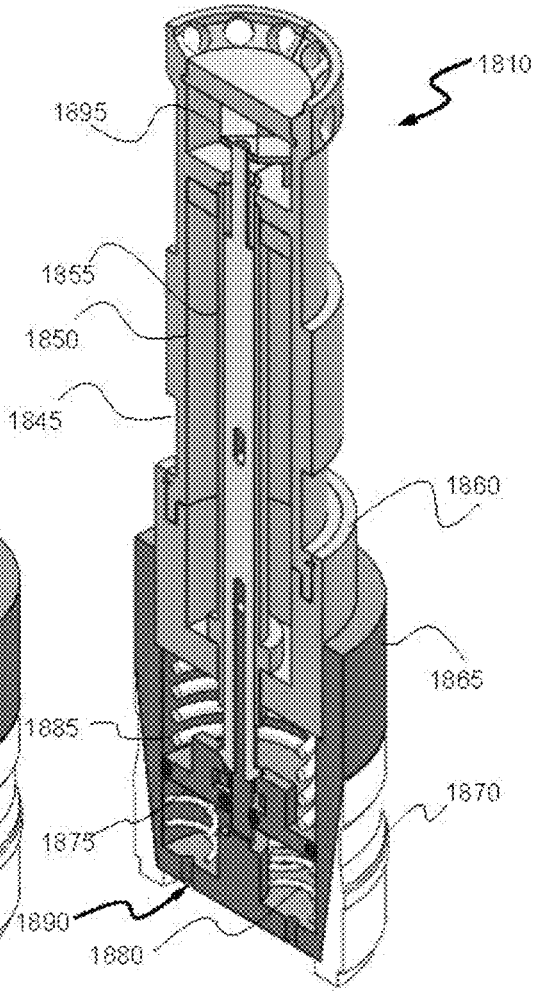
Figure 18C:
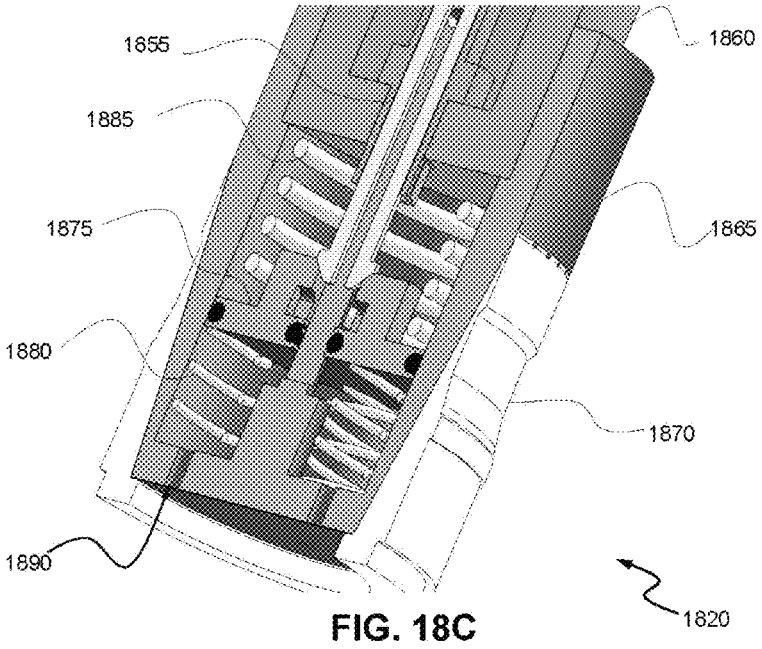

FIGS. 18A, 18B and 18C show views of a mechanical pressure actuated PAPI: isometric assembly 1800, isometric cross-section 1810 and isometric detail 1820, respectively. The assembly view 1800 in FIG. 18A features nose portion 1830, payload portion 1835 and base portion 1840. The cross-section view 1810 in FIG. 18B features four petals 1845 in cruciform pattern enveloping a payload 1850 and a pushrod 1855 (that acts as a retaining pin). The petals 1845 are engaged by a petal collar 1860, which is further enveloped by a base 1865 surrounded by a rotating band 1870.

The detail view 1820 in FIG. 18C shows the base 1865 containing a pressure plate 1875 suspended from the base 1865 by lower helical springs 1880. An upper helical spring 1885 separates the plate 1875 from the petal collar 1860. Orifices 1890 in the bottom of the base 1865 enable propellant gasses to enter the PAPI. The pressure from the gasses elevate the plate 1875 and thereby engage forked tabs 1895 on the pushrod 1855.

Upon muzzle exit, the propelling gasses evacuate the pressure chamber at the rear of the projectile and the upper internal spring 1885 decompresses, drawing the pressure plate back to its original position, along with the latched pushrod 1855. The downward motion of the pushrod withdraws it from a series of tabs within the forward portion of petals 1845, enabling the petals to separate under the residual forces of gun launch. The petals would then be discarded, enabling the payload 1850 contained within to spread and disperse on target.

The delayed opening serves to produce a tight spread pattern for the internal payload 710. Exemplary embodiments facilitate fine tuning into the system. By adjusting the size of the holes 1890 enabling pressure into and out of the system, or altering the size and spring stiffness of the springs 1880 and 1885, the time required for the projectile to open can be customized to the optimal opening time.

Figure 19:
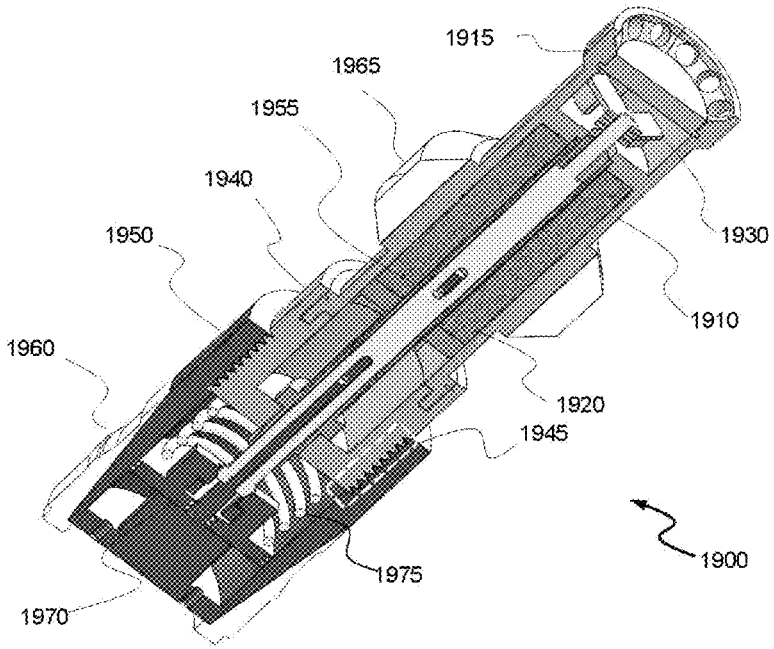
FIG. 19 is an isometric cross-section view of a modified alternate projectile configuration.

FIG. 19 shows an isometric cross-section view 1900 of a modified embodiment of the mechanical pressure PAPI. Four cruciform petals 1910 envelope the nose 1915 and payload 1920, each with a restraining tab 1930 contained within the nose 1915. The petals 1910 are constrained by a petal collar 1940 screwed along a threaded interface 1945 into a base plug 1950. A pushrod 1955 serves to engage the tabs 1930. A rotating band 1960 and a mid-bore rider 1965 respectively surround the plug 1950 and the petals 1910. A pressure plate 1970 is separated from the petal collar 1940 by an upper helical spring 1975. The tabs 1930, collar 1940, pushrod 1955, band 1960, plate 1970 and the spring 1975 are analogous to the previously discussed 1895, 1860, 1855, 1870, 1875 and 1885 in both function and design.

The modified mechanical pressure PAPI functions in essentially the same manner as the mechanical pressure PAPI shown in FIG. 18A-18C. However, the rear springs 1880 have been replaced with a rigid support, threaded interface 1945 has been added to improve component assembly, and a mid-bore rider 1965 has been added to increase the stability of the round as it travels down the barrel. The mid-bore rider renders the projectile more stable by reducing lateral sidesway, or balloting, as the projectile traverses the barrel.

Figure 20:
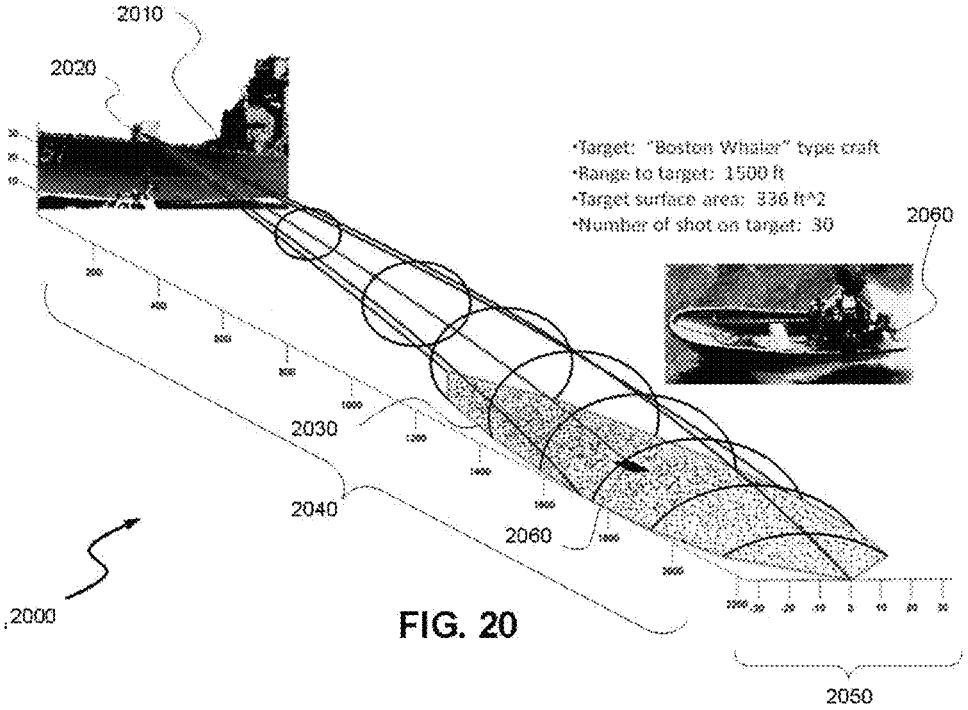
FIG. 20 is a schematic view of a warship with an effective envelope for the projectile.
Figure 21:
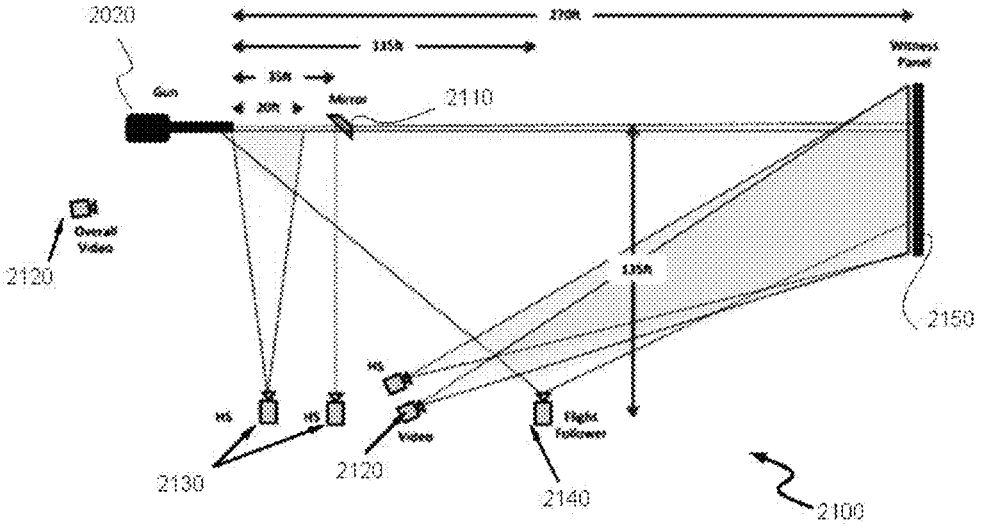
FIG. 21 is a schematic view of a test configuration used for evaluating performance of the projectile.

FIG. 20 shows a diagram view 2000 of a naval destroyer 2010 equipped with a 5" Mk 45 gun 2020 capable of firing within an area 2030 along a downrange length 2040 and a spread width 2050. A "Boston whaler" type target vessel 2060 represents a threat that can be neutralized with the restrainer ring or mechanical pressure PAPI. FIG. 21 shows a diagram view 2100 of a test configuration for the gun 2020 firing a PAPI along various downrange distances. Equipment and instruments, such as a mirror 2110, video cameras 2120, high-speed cameras 2130, a tracking flight follower 2140 record data, and a witness plate 2150 marks distribution of the balls 430 and collects data.

In summary, the external structure for the general PAPI concept includes detachable envelopes, referred to as petals 310, 320, 330, 340, and a base plug 360. The petals are restrained at the bottom of the projectile by the base plug 360, which is surrounded by a gas-sealing obturator 620, and restrained at the top of the projectile by a frangible retainer ring 610 or a mechanical retaining pin as the pushrod 1855.

The PAPI embodiments can employ either the ring 610 or the pushrod 1855. Both PAPI designs share the same mission and are completely inert and without conventional fuzes. However, the retaining ring PAPI actuates payload dispersion by creating fractures at areas of stress concentration in the retainer ring 610 due to the resulting forces of gun launch. The mechanical pressure PAPI actuates payload dispersion by enabling gun propelling gases into a rear chamber and using this pressure increase to elevate the plate 1875 and engage the pushrod 1855, which is then disengaged from the sabot petal structure 1845, enabling payload dispersion.

Returning to the view 2000, upon launch from the gun 2020, the projectile exits the muzzle and becomes subject to various aerodynamic forces. In general the projectile will experience about 110 psi of pressure due to aerodynamic forces at the nose of the projectile and about 288 psi of pressure due to the spin of the PAPI. The pressure on the nose portion 110 of the PAPI acts on the angled nose cone, and the angular velocity pulls the petals 310, 320, 330 and 340 of the projectile away from the center of rotation. These forces separate the petals being held together by the ring 610.

Assembly of the PAPI includes the procedures described as follows. First as in view 1400, the petals connect together by the dowel pins 1360 with silicone between each petal for environmental sealing purposes. This petal assembly slides into a groove in the retainer ring 610 and is secured in place with standard 4-40 screws. Hose clamps can be used at several locations along the payload portion 120 to keep the petals together until attaching the base plug 360. The upper plate 410 acts as a forward constraint for the payload 710 and features the groove 1330 to fit an o-ring to environmentally and pneumatically seal the PAPI from the nose portion 120.

Second as in view 1420, the plate 410 with o-ring slides inside the petal assembly until reaching the groove 1330 on the petals. The snap ring 1440 can then be inserted into the groove 1330 in the petals to keep the plate 410 from falling out of the projectile. This snap ring 1440 also provides support for the petals to be torqued to the base plug 360.

Third as in view 1450, upon installing the upper plate 410, the tungsten ball payload 710 can be installed. The precise number of balls is determined by the overall weight of the projectile, with the intent of keeping the PAPI to the standard 70±1 pounds-mass. For the volume considered, this configuration has room for just under 50 pounds-mass worth of payload which can equate to about 28000⅜" tungsten spheres or balls 430.

The rod 510 is inserted before the payload 710 is poured into the payload portion 120. This all-thread feature enables use of nuts 520 to torque and compress the payload 710 against the lower plate 420, and enables threading into the base plug 360. The lower plate 420 is somewhat more robust than the upper plate 410 to support the payload 710 during setback acceleration upon launch. The lower plate 420 also features an o-ring groove 1030 for environmental and pneumatic sealing.

Fourth as in view 1460, the lower plate 420 slides into the payload portion 120 and contacts the payload 710. The nut 520 (e.g., locknut and lockwasher) are threaded behind the lower plate 420 to enable torque to be applied. The entire assembly continues a process of vibrating and torquing down the nuts 520 until the payload 710 is sufficiently compacted. This compaction restrains the balls 430 from rattling around, but also acts to inhibit the payload 710 from pushing the petals radially outward by hydrostatic pressure setback forces upon firing. This hydrostatic pressure gradates from negligible at the upper plate 410 to a maximum at the lower plate 420, causing premature separation of the petals. By compressing the load, these forces can be normalized and enabling the payload 710 to act as a unitary item instead of several individual balls 530.

Under the pressures and temperatures experienced during shooting aluminum has been shown to melt and burn, causing small particles of aluminum to be deposited on rifle grooves of the gun barrel. The proceeding shot rips this aluminum from these grooves. With the aluminum comes the chrome plating intended to protect the inside of the barrel. Upon removal of the chrome plating, subsequent shots cause pitting in the rifling of the barrel. This pitting causes blow-by reducing the efficiency and accuracy of future rounds. To avoid such deposits, the base plug 360 is composed of steel.

Fifth as in view 1480, the petals slide into the groove 440, and the rod 510 threads into the hole 1140 of the base plug 360. The two holes 1150 enable use of a spanner wrench to thread the base plug 360 onto the rod 510. A bead of silicone will be applied to the groove in the base plate prior to assembly to provide an environmental seal. The base plug 360 turns into the rod 510 until the sides of the petals mate with the top surface of the inner flange 1110.

Sixth as in view 1490, the obturator 620 is prepared by heating in an oven to allow the nylon to expand, as is commonly accomplished with nylon bands. After heating, the obturator 620 is pressed onto the base plug 360 and permitted to cool and thereby shrink into position. This is a practice carried out on the M1040 in addition to multiple other munitions with similar band designs. After installation of the obturator 620 onto the base plug 360, the PAPI is completed and ready for load and launch in the gun 2020.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An inert axisymmetric projectile for launching from a shipboard gun and dispersing submunitions at a target, said projectile comprising:

a cylindrical base plug;

an annular sabot housing formed by a plurality of sabot petals arranged concentrically and separably attached to said plug, said housing including a payload portion and a nose portion, with a passage corridor between said payload and nose portions;

an upper plate pneumatically separating said nose portion said payload portion;

a lower plate pneumatically separating said payload portion from said plug;

a plurality of tungsten spheres contained within said payload portion and constrained radially by said housing; and a separable retainer ring around said nose portion to constrain said plurality of petals, wherein upon launch from the gun, aerodynamic pressure fractures said ring and causes said petals to unfurl, thereby releasing said tungsten spheres for dispersal.

2. The projectile according to claim 1, further comprising:

a slip obturator disposed around said base plug to reduce rotational spin of the projectile.

3. The projectile according to claim 1, wherein said corridor is formed by an arc wall segment on each petal.

4. The projectile according to claim 1, wherein said upper and lower plates comprise steel.

5. The projectile according to claim 1, wherein said ring comprises steel, and said petals comprise aluminum alloy.

6. The projectile according to claim 1, wherein said ring comprises a plurality angular segments corresponding to said petals, said segments joined by tabs that fracture in tension at an established load.

7. The projectile according to claim 1, wherein said plug further includes an annular slip obturator for engaging a muzzle of the gun.

8. The projectile according to claim 7, wherein said obturator comprises nylon.

9. The projectile according to claim 1, wherein said spheres are ⅜" diameter and the projectile can be fired from a 5" diameter gun.

* * * * *